US011667493B2

(12) United States Patent
Gireddy et al.

(10) Patent No.: US 11,667,493 B2
(45) Date of Patent: Jun. 6, 2023

(54) ELEVATOR OPERATION FOR OCCUPANCY

(71) Applicant: OTIS ELEVATOR COMPANY, Farmington, CT (US)

(72) Inventors: Jayapal Reddy Gireddy, Telangana (IN); Ashok Chikkur, Telangana (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 1114 days.

(21) Appl. No.: 16/357,579

(22) Filed: Mar. 19, 2019

(65) Prior Publication Data

US 2019/0284019 A1 Sep. 19, 2019

(30) Foreign Application Priority Data

Mar. 19, 2018 (IN) ..... 201811009977

(51) Int. Cl.

| | |
|---|---|
| ***B66B 1/28*** | (2006.01) |
| ***B66B 1/46*** | (2006.01) |
| ***B66B 5/00*** | (2006.01) |
| ***B66B 1/24*** | (2006.01) |
| ***B66B 1/34*** | (2006.01) |

(52) U.S. Cl.

CPC ..... *B66B 1/28* (2013.01); *B66B 1/2416* (2013.01); *B66B 1/3476* (2013.01); *B66B 1/468* (2013.01); *B66B 5/0012* (2013.01); *B66B 2201/222* (2013.01); *B66B 2201/23* (2013.01); *B66B 2201/402* (2013.01); *B66B 2201/405* (2013.01); *B66B 2201/4661* (2013.01)

(58) Field of Classification Search

CPC ..... B66B 1/28; B66B 1/2416; B66B 1/3476; B66B 1/468; B66B 5/0012; B66B 2201/222; B66B 2201/23; B66B 2201/402; B66B 2201/405; B66B 2201/4661; B66B 1/20

See application file for complete search history.

(56) References Cited

U.S. PATENT DOCUMENTS

| | | | |
|---|---|---|---|
| 5,258,586 | A | 11/1993 | Suzuki et al. |
| 5,382,761 | A | 1/1995 | Amano |
| 5,703,367 | A | 12/1997 | Hashimoto et al. |

(Continued)

FOREIGN PATENT DOCUMENTS

| | | | |
|---|---|---|---|
| CN | 1802304 | A | 7/2006 |
| CN | 101323406 | A | 12/2008 |

(Continued)

OTHER PUBLICATIONS

CN Office Action; dated Feb. 10, 2021; Application No. 201910203786.X; Filed: Mar. 18, 2019, 11 pages.

(Continued)

*Primary Examiner* — Jeffrey Donels

(74) *Attorney, Agent, or Firm* — Cantor Colburn LLP

(57) ABSTRACT

An elevator system is provided. Aspects includes an elevator car, a sensor affixed to the elevator car, wherein the sensor is operated by a controller, the controller is configured to receive occupancy data associated with the elevator car. The occupancy data is analyzed to determine an occupancy of the elevator car. A first hall call is received and based at least in part on the occupancy and the first hall call, adjusting operation of the elevator car in the elevator system.

16 Claims, 4 Drawing Sheets

(56) References Cited

U.S. PATENT DOCUMENTS

| | | | |
|---|---|---|---|
| 6,357,554 | B1 | 3/2002 | Valk et al. |
| 7,140,469 | B2 | 11/2006 | Deplazes et al. |
| 7,743,890 | B2 | 6/2010 | Nikovski et al. |
| 9,079,751 | B2 | 7/2015 | Sundholm et al. |
| 9,573,789 | B2 | 2/2017 | Appana |
| 2008/0073159 | A1* | 3/2008 | Al-Fayez ..... B66B 1/2416 187/381 |
| 2016/0140399 | A1 | 5/2016 | Yano et al. |
| 2016/0297642 | A1 | 10/2016 | Finn et al. |

FOREIGN PATENT DOCUMENTS

| | | | |
|---|---|---|---|
| CN | 103964271 | A | 8/2014 |
| CN | 104229575 | A | 12/2014 |
| CN | 104276468 | A | 1/2015 |
| CN | 104724566 | A | 6/2015 |
| CN | 205274967 | U | 6/2016 |
| CN | 106185494 | A | 12/2016 |
| CN | 106276435 | A | 1/2017 |
| CN | 106315316 | A | 1/2017 |
| CN | 107074484 | A | 8/2017 |
| CN | 107145819 | A | 9/2017 |
| CN | 107235388 | A | 10/2017 |
| CN | 107416629 | A | 12/2017 |
| CN | 107416630 | A | 12/2017 |
| CN | 107487678 | A | 12/2017 |
| CN | 107601202 | A | 1/2018 |
| CN | 107697754 | A | 2/2018 |
| EP | 1074958 | A1 | 7/2001 |
| EP | 1345445 | A1 | 9/2003 |
| EP | 2295361 | A1 | 3/2011 |
| EP | 3281904 | A1 | 2/2018 |
| EP | 3461777 | A1 | 4/2019 |
| GB | 2389415 | A | 12/2003 |
| JP | 2003267637 | A | 9/2003 |
| TW | 203028 | B | 4/1993 |
| WO | 20080130392 | A1 | 10/2008 |

OTHER PUBLICATIONS

EP Search Report; dated Aug. 3, 2019; U.S. Appl. No. 19/162,831.2; Filed: Mar. 14, 2019; 10 pages.

CN Office Action; dated Jul. 8, 2021; Application No. 201910203786.X; Filed: Mar. 18, 2019; 10 pages.

Indian Office Action for Application No. 201811009977; dated Mar. 25, 2021; 5 Pages.

EP Office Action; dated Feb. 2, 2021; Application No. 19162831.2; Filed: Sep. 29, 2017; 13 pages.

CN Notification to Grant Patent Right; dated Nov. 2, 2021; Application No. 201910203786.X; Filed: Mar. 18, 2019; 5 pages.

* cited by examiner

ELEVATOR OPERATION FOR OCCUPANCY

CROSS-REFERENCE TO RELATED APPLICATIONS

This application claims the benefit of Indian provisional application no. 201811009977 filed Mar. 19, 2018, which is incorporated herein by reference in its entirety.

BACKGROUND

The subject matter disclosed herein generally relates to elevator systems and, more particularly, to elevator operation for occupancy.

Elevators, during normal operation, stop and serve all or most floors in a building when they are assigned hall calls despite the presence of a full or almost full occupancy of the elevator car. The inside the cab experience of a passenger is affected based on the occupancy. For example, a full elevator cab can be cramped and cause the occupants some discomfort during the elevator ride.

BRIEF DESCRIPTION

According to one embodiment, an elevator system is provided. The elevator system includes an elevator car, a sensor affixed to the elevator car, wherein the sensor is operated by a controller, the controller is configured to receive occupancy data associated with the elevator car. The occupancy data is analyzed to determine an occupancy of the elevator car. A first hall call is received and based at least in part on the occupancy and the first hall call, adjusting operation of the elevator car in the elevator system.

In addition to one or more of the features described above, or as an alternative, further embodiments of the elevator system may include that the controller is further configured to assign a ranking to the first hall call.

In addition to one or more of the features described above, or as an alternative, further embodiments of the elevator system may include that adjusting operation of the elevator car in the elevator system comprises adjusting the ranking assigned to the first hall call.

In addition to one or more of the features described above, or as an alternative, further embodiments of the elevator system may include that adjusting the operation of the elevator car comprises directing the elevator car to ignore the first hall call.

In addition to one or more of the features described above, or as an alternative, further embodiments of the elevator system may include that the controller receives the occupancy data from the sensor.

In addition to one or more of the features described above, or as an alternative, further embodiments of the elevator system may include that the sensor is a camera.

In addition to one or more of the features described above, or as an alternative, further embodiments of the elevator system may include that the determining the occupancy of the elevator car comprises receiving break-even space data associated with the elevator car and capturing, by the sensor, the occupancy data. The occupancy data is analyzed to determine an amount of free space in the elevator car and the free space is compared to the break-even space data to determine the occupancy.

In addition to one or more of the features described above, or as an alternative, further embodiments of the elevator system may include that the occupancy of the elevator car comprises a percentage calculated from the free space and a total space in the elevator car.

In addition to one or more of the features described above, or as an alternative, further embodiments of the elevator system may include that the break-even space data are inputted by a manager of the elevator system.

In addition to one or more of the features described above, or as an alternative, further embodiments of the elevator system may include that the controller is further configured to receive historical data associated with the elevator car, wherein the historical data comprises peak usage times for the elevator car and adjust the break-even space data based on the historical data.

According to one embodiment, a method for operating an elevator system is provided. The method includes receiving, by a controller, occupancy data associated with an elevator car in the elevator system. The occupancy data is analyzed to determine an occupancy of the elevator car. The controller receives a first hall call and based at least in part on the occupancy the first hall call, adjusts operation of the elevator car in the elevator system.

In addition to one or more of the features described above, or as an alternative, further embodiments of the method may include assigning a ranking to the first hall call.

In addition to one or more of the features described above, or as an alternative, further embodiments of the method may include that adjusting operation of the elevator car in the elevator system comprises adjusting the ranking assigned to the first hall call.

In addition to one or more of the features described above, or as an alternative, further embodiments of the method may include that adjusting the operation of the elevator car comprises directing, by the controller, the elevator car to ignore the first hall call.

In addition to one or more of the features described above, or as an alternative, further embodiments of the method may include that the controller receives the occupancy data from a sensor associated with the elevator car.

In addition to one or more of the features described above, or as an alternative, further embodiments of the method may include that the sensor is a camera.

In addition to one or more of the features described above, or as an alternative, further embodiments of the method may include that the determining the occupancy of the elevator car comprises receiving break-even space data associated with the elevator car and capturing, by the sensor, the occupancy data. The occupancy data is analyzed to determine an amount of free space in the elevator car and the free space is compared to the break-even space data to determine the occupancy.

In addition to one or more of the features described above, or as an alternative, further embodiments of the method may include that the occupancy of the elevator car comprises a percentage calculated from the free space and a total space in the elevator car.

In addition to one or more of the features described above, or as an alternative, further embodiments of the method may include that the break-even space data are inputted by a manager of the elevator system.

In addition to one or more of the features described above, or as an alternative, further embodiments of the method may include receiving historical data associated with the elevator car, wherein the historical data comprises peak usage times for the elevator car and adjust the break-even space data based on the historical data.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
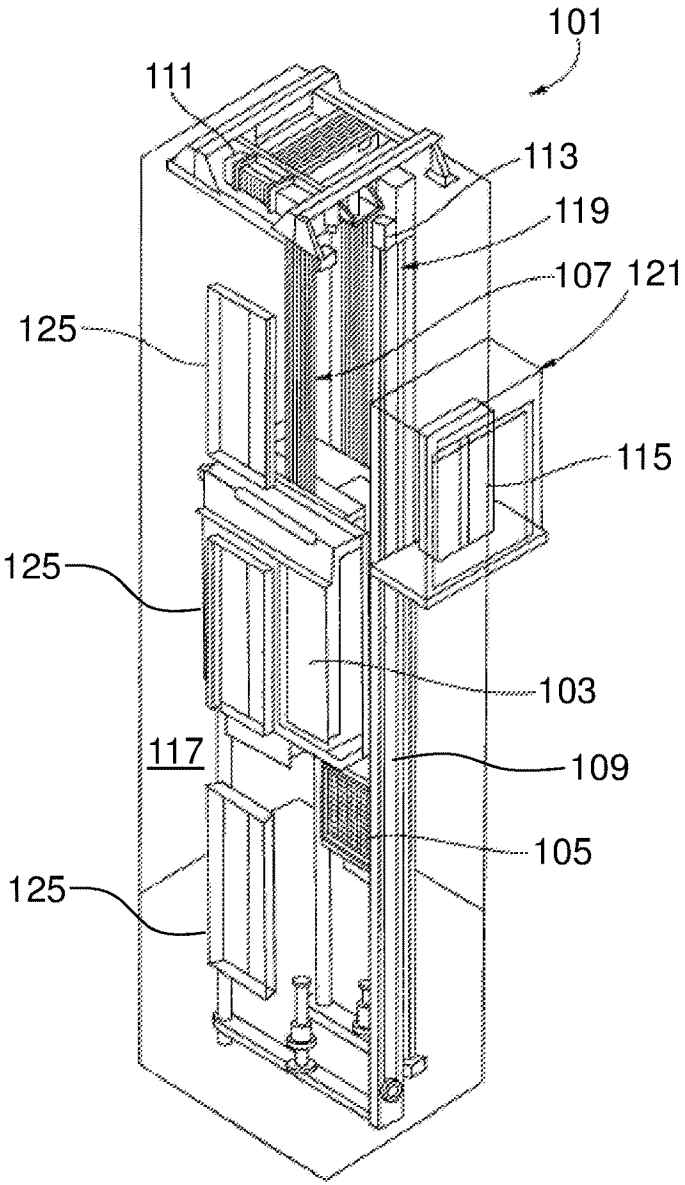
FIG. 1 is a schematic illustration of an elevator system that may employ various embodiments of the disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft, such as hydraulic and/or ropeless elevators, may employ embodiments of the present disclosure. FIG. 1 is merely a non-limiting example presented for illustrative and explanatory purposes.

Figure 2:
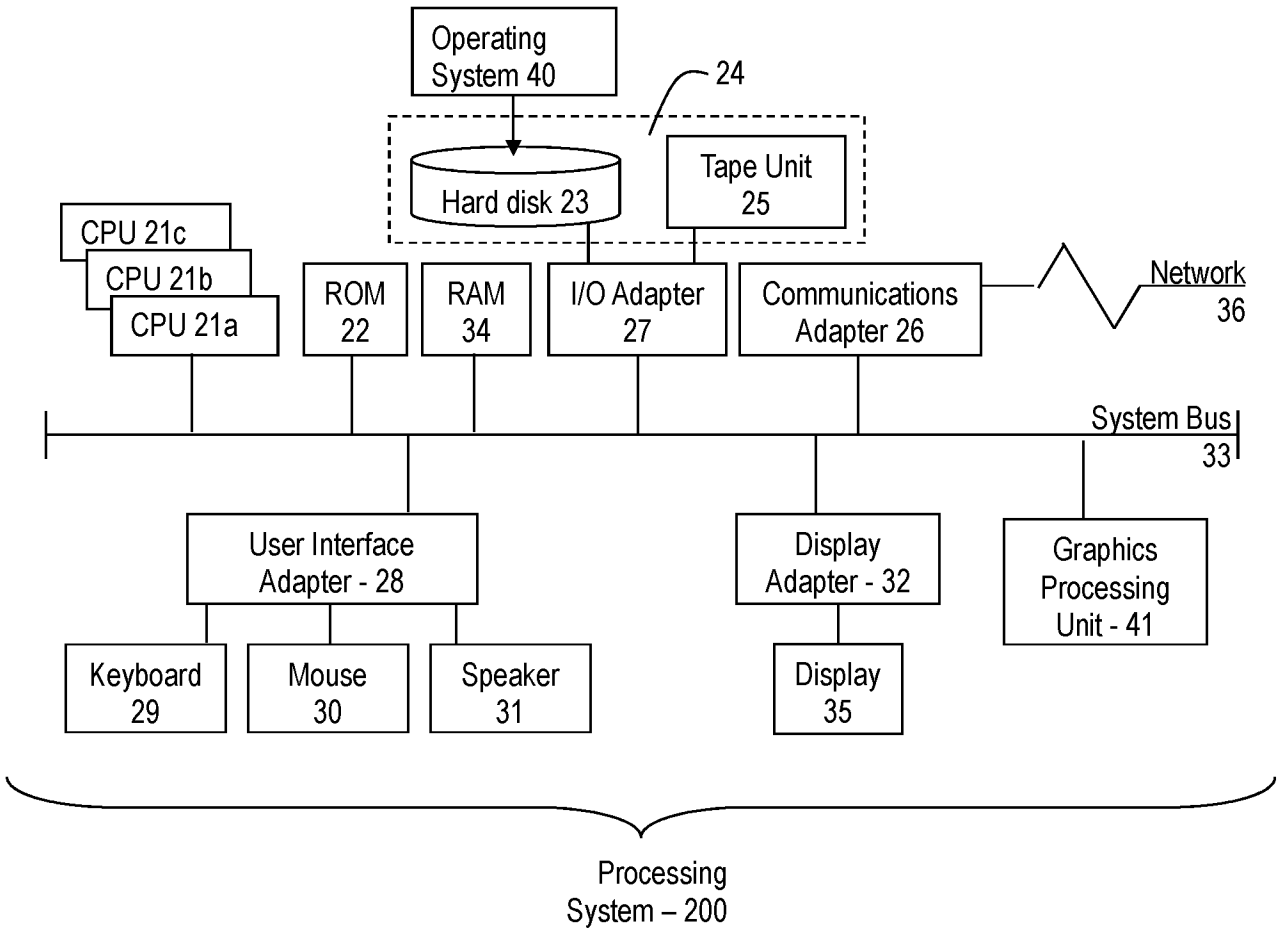
FIG. 2 depicts a block diagram of a computer system for use in implementing one or more embodiments of the disclosure.

Referring to FIG. 2, there is shown an embodiment of a processing system 200 for implementing the teachings herein. In this embodiment, the system 200 has one or more central processing units (processors) 21*a*, 21*b*, 21*c*, etc. (collectively or generically referred to as processor(s) 21). In one or more embodiments, each processor 21 may include a reduced instruction set computer (RISC) microprocessor. Processors 21 are coupled to system memory 34 (RAM) and various other components via a system bus 33. Read only memory (ROM) 22 is coupled to the system bus 33 and may include a basic input/output system (BIOS), which controls certain basic functions of system 200.

FIG. 2 further depicts an input/output (I/O) adapter 27 and a network adapter 26 coupled to the system bus 33. I/O adapter 27 may be a small computer system interface (SCSI) adapter that communicates with a hard disk 23 and/or tape storage drive 25 or any other similar component. I/O adapter 27, hard disk 23, and tape storage device 25 are collectively referred to herein as mass storage 24. Operating system 40 for execution on the processing system 200 may be stored in mass storage 24. A network communications adapter 26 interconnects bus 33 with an outside network 36 enabling data processing system 200 to communicate with other such systems. A screen (e.g., a display monitor) 35 is connected to system bus 33 by display adaptor 32, which may include a graphics adapter to improve the performance of graphics intensive applications and a video controller. In one embodiment, adapters 27, 26, and 32 may be connected to one or more I/O busses that are connected to system bus 33 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 33 via user interface adapter 28 and display adapter 32. A keyboard 29, mouse 30, and speaker 31 all interconnected to bus 33 via user interface adapter 28, which may include, for example, a Super I/O chip integrating multiple device adapters into a single integrated circuit.

In exemplary embodiments, the processing system 200 includes a graphics processing unit 41. Graphics processing unit 41 is a specialized electronic circuit designed to manipulate and alter memory to accelerate the creation of images in a frame buffer intended for output to a display. In general, graphics processing unit 41 is very efficient at manipulating computer graphics and image processing and has a highly parallel structure that makes it more effective than general-purpose CPUs for algorithms where processing of large blocks of data is done in parallel. The processing system 200 described herein is merely exemplary and not intended to limit the application, uses, and/or technical scope of the present disclosure, which can be embodied in various forms known in the art.

Thus, as configured in FIG. 2, the system 200 includes processing capability in the form of processors 21, storage capability including system memory 34 and mass storage 24, input means such as keyboard 29 and mouse 30, and output capability including speaker 31 and display 35. In one embodiment, a portion of system memory 34 and mass storage 24 collectively store an operating system coordinate the functions of the various components shown in FIG. 2. FIG. 2 is merely a non-limiting example presented for illustrative and explanatory purposes.

Turning now to an overview of technologies that are more specifically relevant to aspects of the disclosure, elevator systems, typically, operate in a building with multiple elevator cars serving multiple floors in the building. The elevator system attempts to stop and serve all floors in a building based on hall calls to each floor of the building. Despite being fully occupied, an elevator car can stop at each floor and attempt to serve that floor which can cause issues affecting the passenger experience such as being uncomfortable, increasing travel times. Additionally, the elevator system can experience issues due to hall calls being sent to fully occupied elevator cars such as increased power consumption due to inertia and deceleration of an elevator car at each stop and then increase power consumption to regain acceleration for the elevator car. The controller in the elevator system will also have increased computation due to re-registration of hall calls and unserved hall calls due to occupancy.

Turning now to an overview of the aspects of the disclosure, one or more embodiments address the above-described shortcomings of the prior art by providing an elevator system that operates the elevator cars based on the occupancy of the elevator cars. The elevator system can set break-even space in an elevator car by considering the size of the elevator car. The break-even space can be an installation parameter for the elevator system or it can be set or adjusted by a building manager or an elevator technician. When passengers enter and exit an elevator car, sensors in the elevator car can be utilized to calculate the remaining (or free) space in the elevator car at any one time. A few examples of sensor technology that can be utilized for determining the presence of passengers in the elevator car include 3 dimensional/2 dimensional cameras using image processing techniques, 3 dimensional stereo systems that utilize counter techniques to count the number of passengers in the elevator cab, Doppler radar techniques can be utilized to calculate passenger density, and also load cells arranged on the elevator car floor can be utilized. When a hall call for the elevator system is received, the controller can check if the free space (e.g., remaining space) of the elevator car is less than the break-even space (e.g., threshold) once the elevator starts. If the free space is less than the break-even space, the controller does not assign any hall calls for the elevator car. This can be performed iteratively to account for passengers entering and existing the elevator car when responding to hall calls for the elevator car. If the elevator car is fully occupied, the controller can send an alert or message to a display fixture on the hall stating that the "Car is Full."

Figure 3:
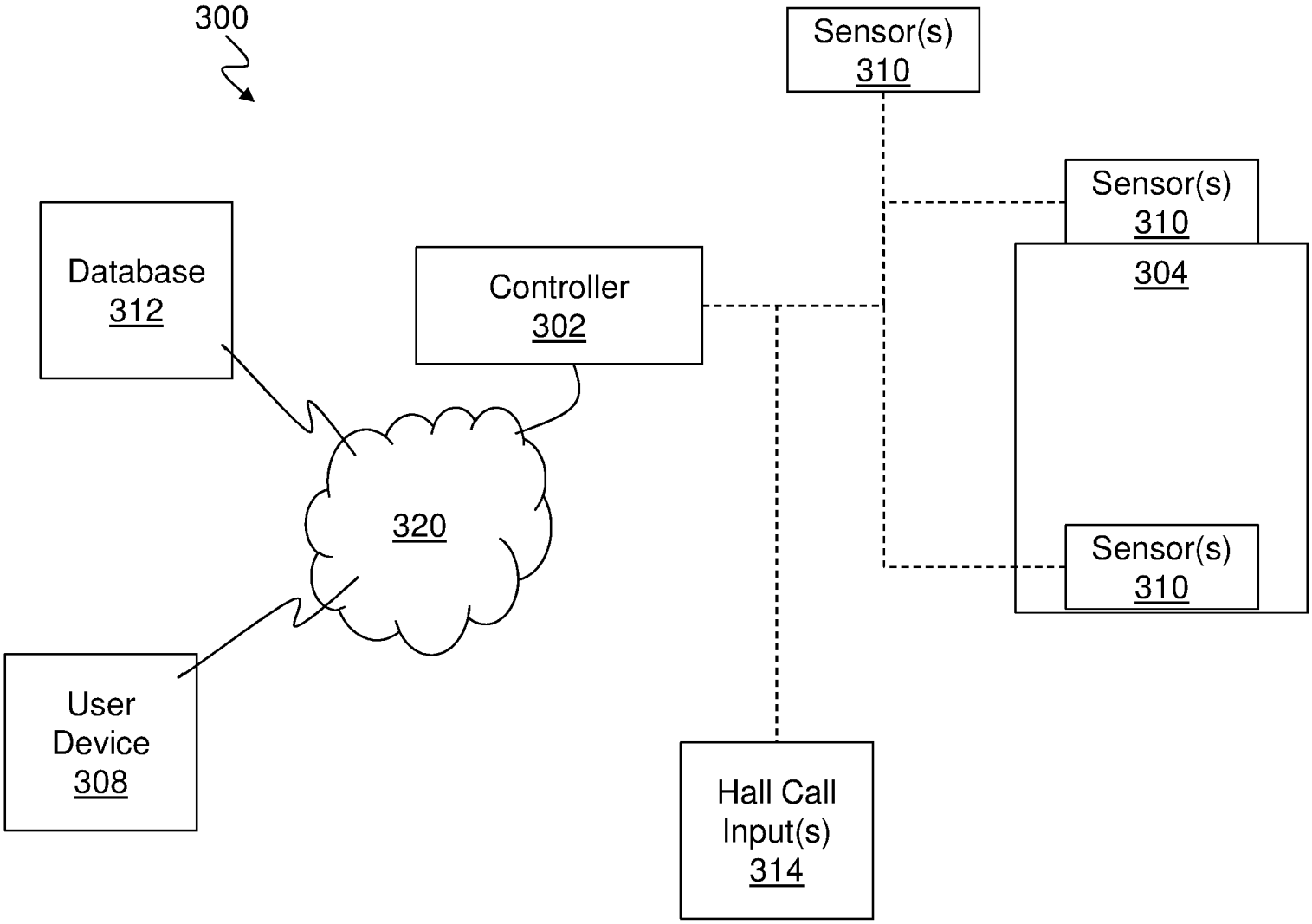
FIG. 3 depicts a block diagram of a system for inspecting an elevator system according to one or more embodiments of the disclosure.

Turning now to a more detailed description of aspects of the present disclosure, FIG. 3 depicts a system 300 for inspecting an elevator system. The system 300 includes an elevator car 304 at least one sensor(s) 310 located on or around the elevator car 304. The system 300 also includes a controller 302, a network 320, a database 312, a user device 308, and at least one hall call input(s) 314.

In one or more embodiments, the controller 302 can be implemented on the processing system 200 found in FIG. 2. Additionally, a cloud computing system can be in wired or wireless electronic communication with one or all of the elements of the system 300. Cloud computing can supplement, support or replace some or all of the functionality of the elements of the system 300. Additionally, some or all of the functionality of the elements of system 300 can be implemented as a node of a cloud computing system. A cloud computing node is only one example of a suitable cloud computing node and is not intended to suggest any limitation as to the scope of use or functionality of embodiments described herein.

In one or more embodiments, the controller 302 is operable to control the elevator car 304 within an elevator system 300. The elevator car 304 can be a part of a larger elevator bank that operates within a multi-story building with the controller controlling the elevator car 304 along with multiple other elevator cars in the same building. The elevator car 304 in the elevator system 300 can be called to a specific floor or level of a building utilizing the hall call input(s) 314. When a hall call is received by the controller 302, the controller 302 utilizes a ranking based assignment methodology to assign an elevator car 304 in the elevator system to the specific hall call. In one or more embodiments, the ranking based assignment can cause the controller 302 to route certain elevator calls to certain floors or levels in the building and even have elevator cars in closer proximity to a hall call location skip a hall call based on the ranking of the hall call as it relates to other hall calls.

In one or more embodiments, the elevator system 300 utilizes the sensors 310 in the elevator car 304 to determine an occupancy for the elevator car 304. In one or more embodiments, the sensors 310 can be cameras that capture images or video of the inside of the elevator car 304. Utilizing image processing techniques, the controller 302 can analyze the capture images or video to determine an occupancy for the elevator car. In one or more embodiments, the occupancy can be calculated utilizing a break-even space (free space threshold) that can be set and/or adjusted at any time based on a variety of factors including but not limited to peak usage times for the elevator. The break-even space can be set as a percentage of free space in the elevator car calculated utilizing image processing and comparing to the size of the elevator car. For example, a break-even space can be set to 10% which allows for an elevator car to have any percentage greater than 10% for free space in the elevator car to continue with normal call operation of the elevator car 304. However, should the free space in the elevator car 304 fall below the break-even space, the controller 302 can cause the elevator car 304 to enter non-stop mode which would have the elevator car 304 ignore any hall calls until the free space in the elevator car is over the break-even space.

In one or more embodiments, the sensors 310 can be any type of camera that can be used to generate video and/or still frame images. The cameras can capture any type of video images such as, for example, infrared images, depth, image, and the like. The cameras can be wired or wireless cameras that can connect to the controller 302 through a wired or wireless network connection. The cameras mentioned herein are only examples of suitable camera types and are not intended to suggest any limitation as to the scope of use or functionality of the cameras.

In one or more embodiments, the sensors 310 can be a stereo system that can count passengers as the passengers enter the elevator car 304. As passengers enter the elevator car 304, the controller 302 can utilize logic to estimate the occupancy of the elevator car 304 based on the passenger count. In another embodiments, the sensors 310 can be Doppler radar utilize to calculate passenger density. The controller 302 can utilize logic to calculate an occupancy of the elevator car 304 based on this density data taken from the sensors 310.

In one or more embodiments, historical data associated with elevator system 300 usage can be recorded and stored in the database 312. The historical data can be utilized to adjust the break-even space for the elevator car 304. For example, the historical data can include peak usage times for the elevator system 300. During the peak usage times, the break-even space can be lowered to accommodate an increase in passenger utilization. Certain times during a "morning rush," passengers might expect the elevator car to be more crowded and the passenger experience will not be affected because of the increase in passenger density. During non-peak times, the break-even space can be adjusted back to allow for a better customer experience. In one or more embodiments, the historical data can include power consumption of the elevator system 300 over the course of a time interval. Based on an analysis of the power consumption, the controller 302 can adjust the break-even space to optimize the elevator car 304 to reduce power consumption. For example, break-even space can be adjusted to allow an elevator car 304 accommodate more passengers and reduce the number of trips made by the elevator cars 304 in the elevator system 300. Additionally, by setting a fully occupied elevator car 304 to non-stop mode, the power consumption savings can be realized through reduced stops and acceleration after stops. In one or more embodiments, a flag can be utilized to enable peak time hours handling and to set peak time break even space automatically. The flag can also be an installation parameter when this can be enabled/disabled remotely by a building manager, technician, and remotely by means of an application through a cloud platform.

In one or more embodiments, sensors 310 can be located at or near the hall call inputs 314 to determine a number of potential passengers at each floor location that might be waiting for an elevator car 304. The number of potential passengers at each floor can adjust the ranking of the hall calls and route elevator cars 304 to specific hall call locations based on the current occupancy of each elevator car 304. For example, if there are two hall calls and at one hall call location there is a larger number of passengers waiting (such as the lobby), an elevator car 304 with the larger amount of free space could be routed to the hall call with the larger number of passengers. The controller 302 can optimize assignment (e.g., ranking) of hall calls based on the potential passengers.

In one or more embodiments, in addition to hall calls as an input, a user device 308 can be used for an input or a compass input can utilized as well.

Figure 4:
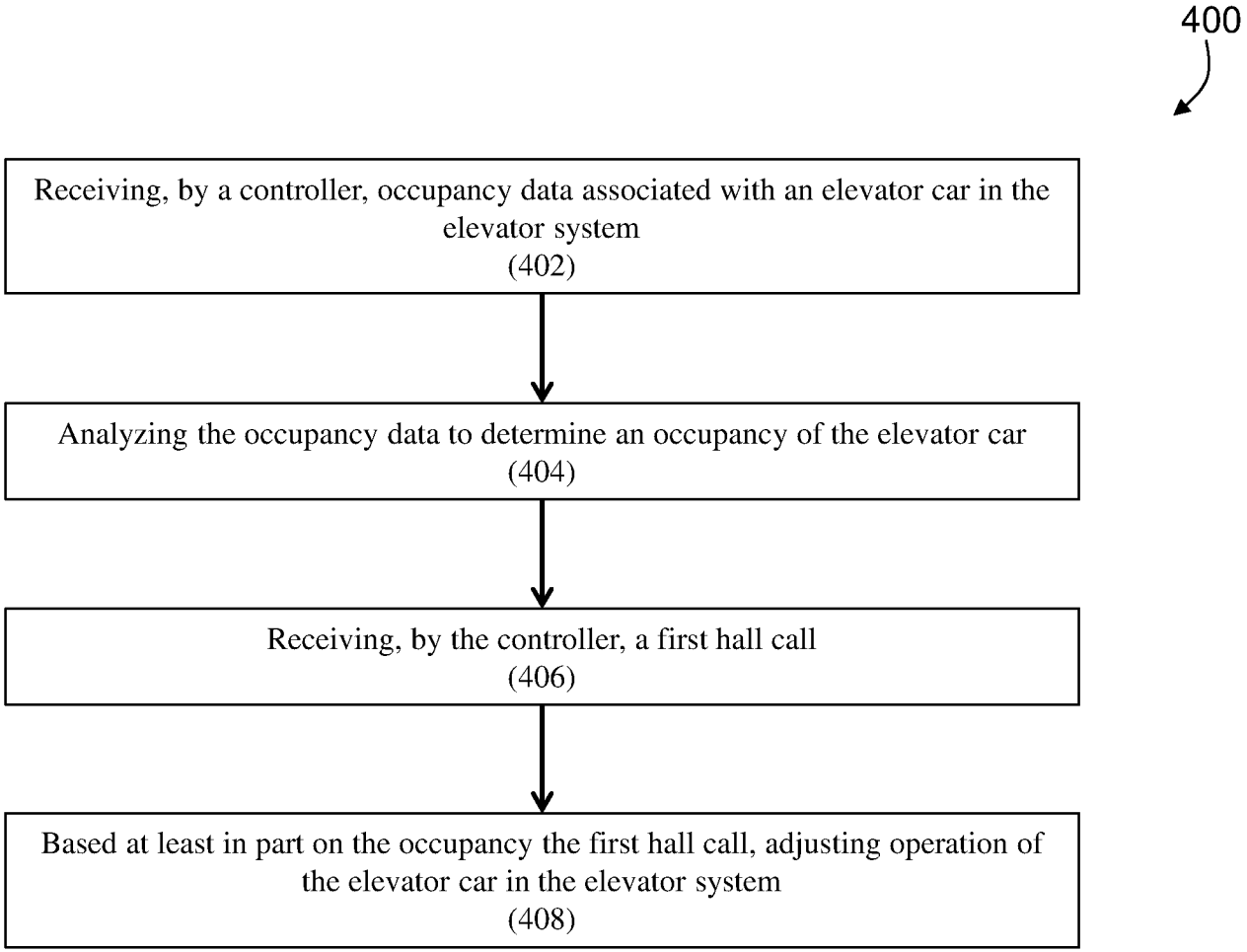
FIG. 4 depicts a flow diagram of a method for operating an elevator system according to one or more embodiments of the disclosure.

FIG. 4 depicts a flow diagram of a method for inspecting an elevator system according to one or more embodiments. The method 400 includes receiving, by a controller, occupancy data associated with an elevator car in the elevator system, as shown at block 402. At block 404, the method 400 includes analyzing the occupancy data to determine an occupancy of the elevator car. The method 400, at block 406, includes receiving, by the controller, a first hall call. The hall call being entered by a user of the elevator system at a hall call input 314. An example of a hall call input 314 include a button or other input indicating the calling of an elevator car. At block 408, the method 400 also includes based at least in part on the occupancy the first hall call, adjusting operation of the elevator car in the elevator system.

Additional processes may also be included. It should be understood that the processes depicted in FIG. 4 represent illustrations and that other processes may be added or existing processes may be removed, modified, or rearranged without departing from the scope and spirit of the present disclosure.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An elevator system comprising:
- an elevator car;
- a sensor affixed to the elevator car, wherein the sensor is operated by a controller; and
- wherein the controller is configured to:
  - receive occupancy data associated with the elevator car;
  - analyze the occupancy data to determine an occupancy of the elevator car;
  - receive a first hall call; and
  - based at least in part on the occupancy and the first hall call, adjusting operation of the elevator car in the elevator system;
  - wherein the controller is further configured to assign a ranking to the first hall call;
  - wherein the controller receives the occupancy data from the sensor.

2. The elevator system of claim 1, wherein adjusting operation of the elevator car in the elevator system comprises adjusting the ranking assigned to the first hall call.

3. The elevator system of claim 1, wherein adjusting the operation of the elevator car comprises: directing the elevator car to ignore the first hall call.

4. The elevator system of claim 1, wherein the sensor is a camera.

5. An elevator system comprising:

an elevator car;

a sensor affixed to the elevator car, wherein the sensor is operated by a controller; and wherein the controller is configured to:

receive occupancy data associated with the elevator car;

analyze the occupancy data to determine an occupancy of the elevator car;

receive a first hall call; and based at least in part on the occupancy and the first hall call, adjusting operation of the elevator car in the elevator system;

wherein the determining the occupancy of the elevator car comprises:

receiving break-even space data associated with the elevator car;

capturing, by the sensor, the occupancy data;

analyzing the occupancy data to determine an amount of free space in the elevator car; and comparing the free space to the break-even space data to determine the occupancy.

6. The elevator system of claim 5, wherein the occupancy of the elevator car comprises a percentage calculated from the free space and a total space in the elevator car.

7. The elevator system of claim 5, wherein the break-even space data are inputted by a manager of the elevator system.

8. The elevator system of claim 5, wherein the controller is further configured to:

receive historical data associated with the elevator car, wherein the historical data comprises peak usage times for the elevator car; and adjust the break-even space data based on the historical data.

9. A computer-implemented method for operating an elevator system comprising:

receiving, by a controller, occupancy data associated with an elevator car in the elevator system;

analyzing the occupancy data to determine an occupancy of the elevator car;

receiving, by the controller, a first hall call;

based at least in part on the occupancy the first hall call, adjusting operation of the elevator car in the elevator system;

assigning a ranking to the first hall call;

wherein the controller receives the occupancy data from a sensor associated with the elevator car.

10. The computer implemented method of claim 9, wherein adjusting operation of the elevator car in the elevator system comprises adjusting the ranking assigned to the first hall call.

11. The computer implemented method of claim 9, wherein adjusting the operation of the elevator car comprises directing, by the controller, the elevator car to ignore the first hall call.

12. The computer implemented method of claim 9, wherein the sensor is a camera.

13. A computer-implemented method for operating an elevator system comprising:

receiving, by a controller, occupancy data associated with an elevator car in the elevator system;

analyzing the occupancy data to determine an occupancy of the elevator car;

receiving, by the controller, a first hall call;

based at least in part on the occupancy the first hall call, adjusting operation of the elevator car in the elevator system;

wherein the determining the occupancy of the elevator car comprises:

receiving break-even space data associated with the elevator car;

capturing, by the sensor, the occupancy data;

analyzing the occupancy data to determine an amount of free space in the elevator car; and comparing the free space to the break-even space data to determine the occupancy.

14. The computer implemented method of claim 13, wherein the occupancy of the elevator car comprises a percentage calculated from the free space and a total space in the elevator car.

15. The computer implemented method of claim 13, wherein the break-even space data are inputted by a manager of the elevator system.

16. The computer implemented method of claim 13, further comprising:

receiving historical data associated with the elevator car, wherein the historical data comprises peak usage times for the elevator car; and adjusting the break-even space data based on the historical data.

* * * * *